US008626044B2

(12) United States Patent
Ohba et al.

(10) Patent No.: US 8,626,044 B2
(45) Date of Patent: Jan. 7, 2014

(54) IMAGE FORMATION APPARATUS

(75) Inventors: Keisuke Ohba, Osaka (JP); Yoshiaki Tashiro, Osaka (JP)

(73) Assignee: Kyocera Mita Corporation (JP)

( * ) Notice: Subject to any disclaimer, the term of this patent is extended or adjusted under 35 U.S.C. 154(b) by 208 days.

(21) Appl. No.: 13/192,557

(22) Filed: Jul. 28, 2011

(65) Prior Publication Data

US 2012/0027475 A1 Feb. 2, 2012

(30) Foreign Application Priority Data

Jul. 29, 2010 (JP) ..... 2010-170337

(51) Int. Cl.
*G03G 15/16* (2006.01)

(52) U.S. Cl.
CPC ..... *G03G 15/165* (2013.01)
USPC ..... 399/316

(58) Field of Classification Search
USPC ..... 399/316
See application file for complete search history.

(56) References Cited

U.S. PATENT DOCUMENTS

| | | | | |
|---|---|---|---|---|
| 4,943,863 | A * | 7/1990 | Ainoya | 399/297 |
| 5,276,489 | A * | 1/1994 | Kikuchi et al. | 399/316 |
| 5,453,823 | A | 9/1995 | Hashizume et al. | |
| 5,594,539 | A * | 1/1997 | Murano et al. | 399/316 |
| 5,819,134 | A * | 10/1998 | Sato et al. | 399/69 |
| 7,630,673 | B2 * | 12/2009 | Michishita | 399/316 |

FOREIGN PATENT DOCUMENTS

| | | |
|---|---|---|
| JP | 6-332322 | 12/1994 |
| JP | 2001117375 | 4/2001 |
| JP | 200412851 | 1/2004 |
| JP | 2009186763 | 8/2009 |
| JP | 201085491 | 4/2010 |

* cited by examiner

*Primary Examiner* — Walter L Lindsay, Jr.
*Assistant Examiner* — Philip Marcus T Fadul
(74) *Attorney, Agent, or Firm* — Gerald E. Hespos; Michael J. Porco; Matthew T. Hespos

(57) ABSTRACT

An image formation apparatus has an image carrier for carrying a toner image, a transfer element for electrostatically transferring the toner image on the image carrier to a sheet, and a guide element for guiding the sheet. The image carrier and the transfer element form a nip portion for nipping the sheet, the guide element includes a main guide configured to guide the sheet toward the nip portion and a sub-guide protruding from the main guide toward the nip portion, and the sub-guide is conductive.

6 Claims, 8 Drawing Sheets

IMAGE FORMATION APPARATUS

BACKGROUND OF THE INVENTION

1. Field of the Invention

The present invention is related to an image formation apparatus with a sheet delivery structure which facilitates a smooth transfer of a toner image.

2. Description of the Related Art

An image formation apparatus such as a copier, a facsimile apparatus or a printer typically has a transfer structure for transferring a toner image formed on an image carrier to a sheet. The transfer structure has a photosensitive drum which is used as the image carrier, a transfer roller which forms a nip portion in cooperation with the photosensitive drum, and a guide element which guides the sheet nearby the peripheral surface of the photosensitive drum.

The guide element includes a main guide configured to define a delivery path through which the sheet passes, and a sub-guide attached to the main guide. The main guide has a tip portion near the peripheral surface of the photosensitive drum. The sub-guide which protrudes from the tip portion of the main guide toward the nip portion partially occupies a space from the tip portion of the main guide to the nip portion, so that the sheet is stably supported by the sub-guide. Thus, failures in toner image transfer because of trailing end flapping of a sheet become less likely.

The aforementioned sub-guide is formed of a synthetic resin film. In addition, a thickness of the sub-guide is determined for appropriate elastic characteristics, which work for better adhesion of the sheet to the peripheral surface of the photosensitive drum.

Friction between the sub-guide made of synthetic resin and a sheet causes electrostatic charge of the sub-guide. The electrostatic charge of the sub-guide causes toner scattering from the photosensitive drum. Contamination of the sub-guide resulting from the toner scattering eventually causes stains on the sheet (stains on a blank surface opposite to a transfer surface onto which the toner image is transferred).

An increase in distance between the sub-guide and the photosensitive drum in order to avoid the stains on the blank surface results in insufficient support for a sheet moving toward the nip portion. As a result, failures in the transfer may be caused by the sheet flapping.

SUMMARY OF THE INVENTION

An object of the present invention is to provide an image formation apparatus for suitably performing transfer of a toner image.

An image formation apparatus for forming a toner image on a sheet according to one aspect of the present invention including: an image carrier configured to carry the toner image; a transfer element configured to electrostatically transfer the toner image on the image carrier to the sheet; and a guide element configured to guide the sheet, wherein the image carrier and the transfer element form a nip portion for nipping the sheet, and the guide element includes a main guide configured to guide the sheet toward the nip portion and a conductive sub-guide protruding from the main guide toward the nip portion.

DETAILED DESCRIPTION OF THE PREFERRED EMBODIMENTS

Image formation apparatuses according to various embodiments are described hereinafter with reference to the accompanying drawings. It should be noted that directional terms hereinafter such as "above", "below", "left", "right" and alike are used only for the purpose of clarification of the description, and are not intended to limit embodiments of the image formation apparatus.

<First Embodiment>

(Entire Structure of Image Formation Apparatus)

Figure 1:
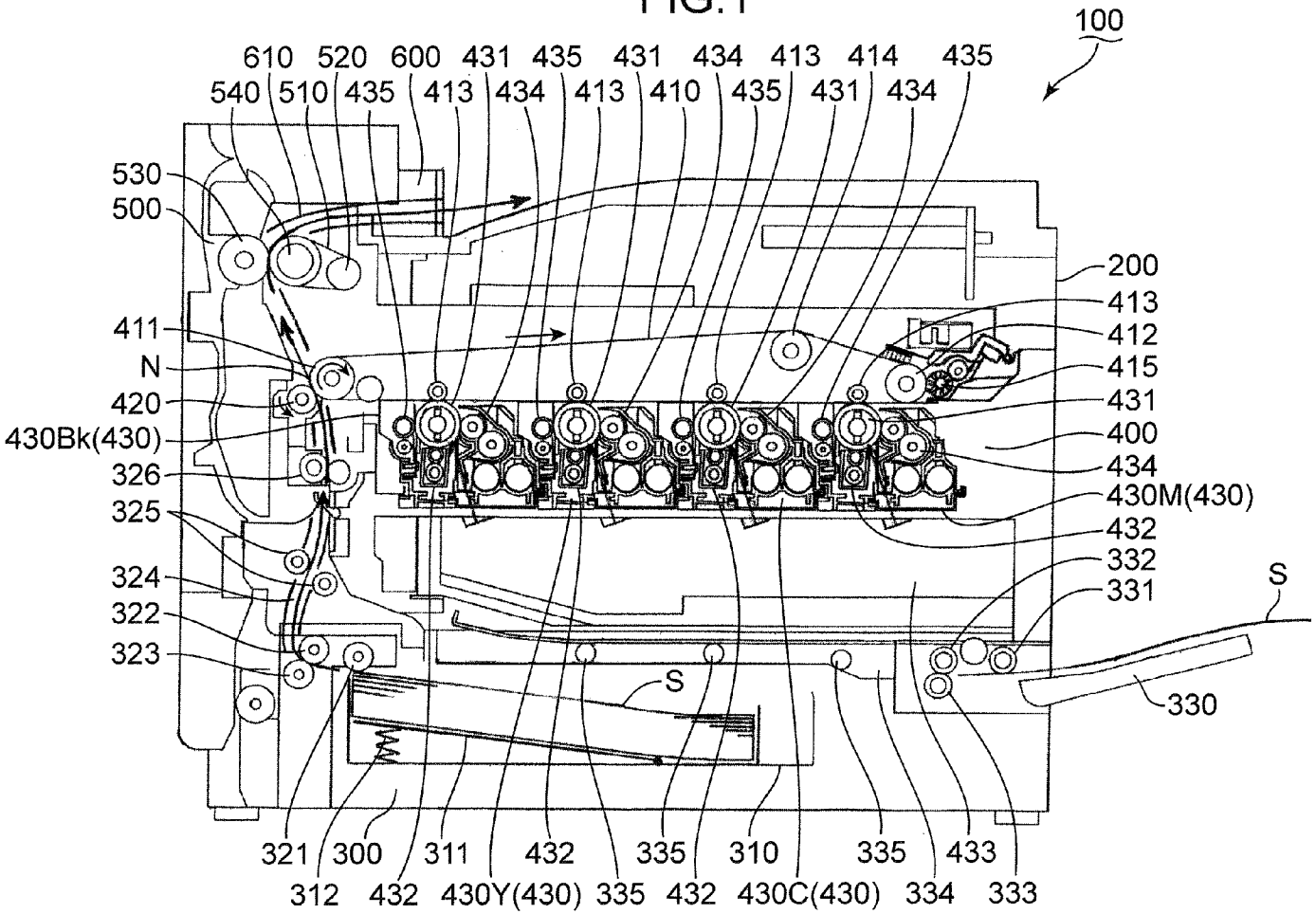
FIG. 1 is a schematic view of an image formation apparatus according to the first embodiment.

FIG. 1 schematically shows an internal structure of an image formation apparatus according to the first embodiment. The image formation apparatus described in connection with the first embodiment is a tandem type color printer. It should be noted that the present embodiments may be applied to a printer, a copier, a facsimile apparatus, a multifunction peripheral having functions thereof in combination, or another apparatus configured to perform printing by transferring a toner image to the surface of a print medium on the basis of external image inputs.

A color printer 100 has a substantially rectangular boxed housing 200. The color printer 100 includes a delivery mechanism 300 configured to deliver a sheet S in the housing 200, an image formation section 400 configured to form a toner image on the sheet S delivered by the delivery mechanism 300, a fixing section 500 configured to fix the toner image on the sheet S, and a discharge section 600 configured to discharge the sheet S to the outside of the housing 200.

The delivery mechanism 300 has a cassette 310 configured to store sheets S. A user may pull the cassette 310 from the housing 200 as appropriate. Thereafter, the user may place a stack of sheets S in the cassette 310, and then put the cassette 310 back in the housing 200. The cassette 310 includes a lift plate 311 configured to support the stack of the sheets S, and a push-up mechanism 312 configured to push up and tilt the lift plate 311.

The delivery mechanism 300 includes a pick-up roller 321. The pick-up roller 321 abuts on the lead edge of a sheet S on the lift plate 311, which is pushed up by the push-up mechanism 312. The pick-up roller 321 rotates to discharge the sheet S from the cassette 310.

The delivery mechanism 300 has a feed roller 322 and a separation roller 323, which are arranged after the pick-up roller 321. The feed and separation rollers 322, 323 are arranged to hold a sheet S discharged from the cassette 310 by the pick-up roller 321 therebetween. The feed roller 322 rotates to deliver the sheet S further downstream. The separation roller 323 rotates to return the sheet S to the cassette 310. As a result, several sheets S stacked on each other, which have been sent out from the cassette 310 by the pick-up roller 321, are appropriately separated by the feed and separation rollers 322, 323. Thus, only the sheet S in direct contact with the feed roller 322 is delivered downstream one by one.

The delivery mechanism 300 includes a feed path 324 which extends upwardly from the feed roller 322, and a delivery roller 325 which upwardly sends the sheet S. The feed path 324 extends toward a nip portion N formed between a transfer belt 410 and a transfer roller 420 of the image formation section 400 described later.

The delivery mechanism 300 has a resist roller pair 326 disposed immediately before the nip portion N. The resist roller pair 326 sends sheets S, which have been delivered along the feed path 324 by the delivery roller 325, toward the nip portion N in synchronization with formation of toner images in the image formation section 400.

The delivery mechanism 300 includes a pivotal manual feed tray 330 attached to the housing 200. A user may rotate the manual feed tray 330 so that the manual feed tray 330 protrudes from the outer surface of the housing 200. Thereafter, the user may place a sheet S on the manual feed tray 330.

The delivery mechanism 300 includes a pick-up roller 331 situated near the pivotal manual feed tray 330, which is supported by the housing 200. The pick-up roller 331 abutting on the lead edge of a sheet S on the manual feed tray 330 rotates to pull the sheet S into the housing 200.

The delivery mechanism 300 includes a feed roller 332 and a separation roller 333, which are arranged after the pick-up roller 331. The feed and separation rollers 332, 333 are arranged to hold a sheet S together, which has been pulled into the housing 200 by the pick-up roller 331. The feed roller 332 rotates to deliver the sheet S further downstream. The separation roller 333 rotates to return the sheet S to the manual feed tray 330. As a result, several the sheets S stacked on each other, which have been sent from the manual feed tray 330 by the pick-up roller 331, are appropriately separated by the feed and separation rollers 332, 333. Thus, only the sheet S in direct contact with the feed roller 332 is delivered downstream one by one.

The delivery mechanism 300 includes a joining path 334 which extends from the feed roller 332 toward the feed path 324, and several delivery rollers 335 disposed along the joining path 334. The joining path 334 substantially horizontally extending above the cassette 310 is curved upwardly, and joins with the feed path 324 immediately before the resist roller pair 326. Consequently, sheets S sent from the manual feed tray 330 are also delivered toward the nip portion N by the resist roller pair 326 in synchronization with formation of toner images in the image formation section 400.

As described above, the image formation section 400 forms toner images on sheets S, which have sent to the nip portion N by the resist roller pair 326. The image formation section 400 includes an image formation unit 430 in addition to the aforementioned transfer belt 410 and transfer roller 420. The image formation unit 430 includes a first image formation unit 430M configured to form images using magenta toner, a second image formation unit 430C configured to form images using cyan toner, a third image formation unit 430Y configured to form images using yellow toner, and a fourth image formation unit 430Bk configured to form images using black toner. Toner images formed by the first to fourth image formation units 430M, 430C, 430Y, 430Bk are sequentially transferred onto the transfer belt 410. The toner images are superimposed on the transfer belt 410 to become one full-color toner image. The transfer belt 410 carries and delivers the full-color toner image to the nip portion N. In the present embodiment, the transfer belt 410 is exemplified as the image carrier configured to carry a toner image. In addition, in the present embodiment, the outer peripheral surface of the transfer belt 410 is exemplified as the first peripheral surface configured to carry the toner image. Alternatively, a photosensitive drum used in a typical image formation apparatus or another apparatus configured to carry toner images may also be worked as the image carrier.

As described above, the transfer belt 410 and the transfer roller 420 form the nip portion N for nipping a sheet S. The transfer roller 420 applies a voltage of polarity, which is opposite to that of the toner on the transfer belt 410, to the sheet S. As a result, the full-color toner image on the transfer belt 410 is electrostatically transferred onto the sheet S. In the present embodiment, the transfer roller 420 is exemplified as the transfer element. In addition, the outer peripheral surface of the transfer roller 420 pressed to the outer peripheral surface of the transfer belt 410 is exemplified as the second peripheral surface which forms the nip portion N. Alternatively, another apparatus configured to electrostatically transfer a toner image from the image carrier to a sheet S may be used as the transfer element.

The image formation unit 430 includes a substantially cylindrical photosensitive drum 431, a charge device 432 situated below the photosensitive drum 431, and an exposure device 433 situated below the charge device 432. The charge device 432 uniformly charges the peripheral surface of the rotating photosensitive drum 431. The exposure device 433 performs scanning laser light in response to image signals outputted from external equipment such as a computer and alike. As a result, charges on the peripheral surface of the photosensitive drum 431 caused by the charge device 432 partially disappear, which results in an electrostatic latent image.

The image formation unit 430 has a development device 434 configured to supply toner to the peripheral surface of the photosensitive drum 431. The toner supply from the development device 434 to the peripheral surface of the photosensitive drum 431 on which there is an electrostatic latent image makes a toner image corresponding to the electrostatic latent image appear on the peripheral surface of the photosensitive drum 431. Thereafter, as described above, the toner image is transferred onto the transfer belt 410.

The image formation section 400 includes a drive roller 411 and an idler 412. The transfer belt 410 situated on the photosensitive drum 431 is tensioned between the drive roller 411 and the idler 412. The image formation section 400 includes transfer rollers 413, which are situated on the photosensitive drums 431 of the first to fourth image formation units 430M, 430C, 430Y, 430Bk, respectively. The transfer belt 410 is pushed by each transfer rollers 413 against the peripheral surface of each photosensitive drum 431 on which there is a toner image. The drive roller 411 rotates the transfer belt 410 at a speed substantially equal to that of the peripheral surface of the photosensitive drum 431. Thus, the toner image on the photosensitive drum 431 is appropriately transferred onto the outer peripheral surface of the transfer belt 410.

The image formation section 400 includes a tension roller 414 abutting on the inner peripheral surface of the transfer belt 410. The upwardly biased tension roller 414 appropriately maintains tension of the transfer belt 410 to stabilize tracking of the transfer belt 410. Thus, transfer of a toner image from the photosensitive drum 431 to the transfer belt 410 (a primary transfer) and transfer of a toner image from the transfer belt 410 to a sheet S (a secondary transfer) are appropriately performed.

The image formation unit 430 includes a first cleaning device 435. The first cleaning device 435 removes toner remaining on the peripheral surface of the photosensitive drum 431 after the primary transfer. The peripheral surface of the photosensitive drum 431 cleaned by the first cleaning device 435 is recharged by the charge device 432. Thereafter, a new toner image is formed on the peripheral surface of the photosensitive drum 431.

The image formation section 400 includes a second cleaning device 415. The second cleaning device 415 removes toner remaining on the outer peripheral surface of the transfer belt 410 after the secondary transfer. New toner images are transferred to the peripheral surface of the transfer belt 410 cleaned by the second cleaning device 415.

After a toner image is transferred onto a sheet S at the nip portion N, the sheet S moves toward the fixing section 500.

The fixing section 500 configured to fix a toner image on a sheet S includes a fixing belt 510, a heating roller 520 configured to heat the fixing belt 510, a pressure roller 530 configured to apply pressure to the sheet S, and a fixing roller 540 configured to press the fixing belt 510 to the pressure roller 530. The heating roller 520 may have, for example, an electric heat generator therein. Thermal energy from the electric heat generator is transmitted to the fixing belt 510 via the heating roller 520. The fixing belt 510 tensioned between the heating and fixing rollers 520, 540 holds the sheet S, which carries a full-color toner image, between the fixing belt 510 and the pressure roller 530. The fixing roller 540 pushes the heated fixing belt 510 against the sheet S, and melts toner on the sheet S. As a result, the toner image is fixed on the sheet S.

The discharge section 600 includes a discharge path 610 extending from the fixing section 500 to the outside of the housing 200. A sheet S passed the fixing section 500 is discharged to the outside of the housing 200 through the discharge path 610. The sheet S discharged by the discharge section 600 is stacked on the upper surface of the housing 200.

(Guide Structure to Nip Portion)

Figure 2:
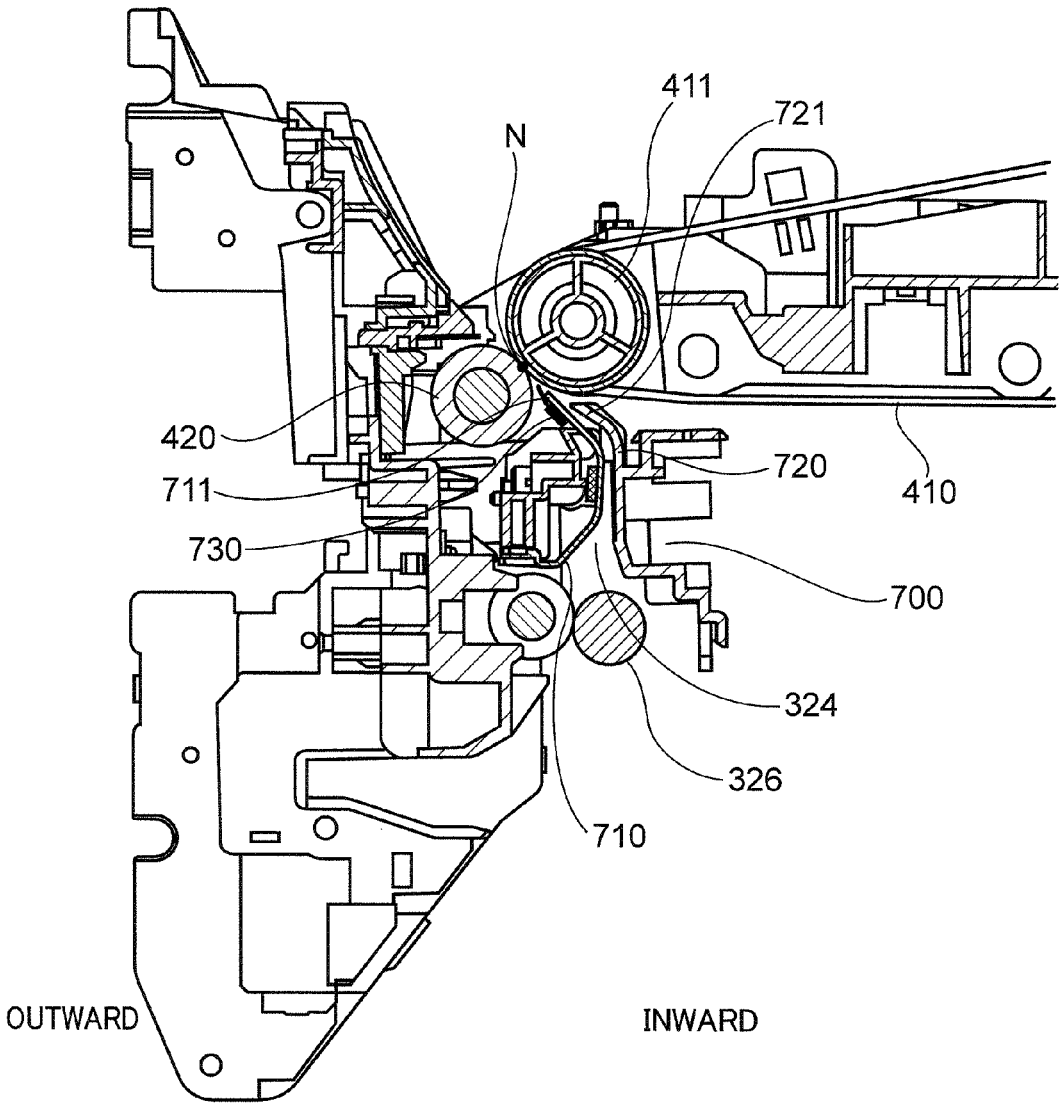
FIG. 2 is a schematic view of a guide structure provided in the image formation apparatus depicted in FIG. 1.

FIG. 2 is a cross-sectional view schematically showing a guide structure to the nip portion N. The guide structure for the nip portion N is described with reference to FIGS. 1 and 2.

The transfer roller 420 is pushed against the peripheral surface of the transfer belt 410, which is curved in an arc shape along the peripheral surface of the drive roller 411 to form the nip portion N. The resist roller pair 326 is situated below the nip portion N. The delivery mechanism 300 includes a guide structure 700 configured to guide sheets S in a section from the resist roller pair 326 to the nip portion N. In the present embodiment, the guide structure 700 is exemplified as the guide element configured to guide a sheet S.

The guide structure 700 includes a first guide plate 710 which is curved in a substantially arc shape, and a second guide plate 720 which is disposed in a more interior side of the housing 200 than the first guide plate 710. The aforementioned feed path 324 is partially formed between the first and second guide plates 710, 720. The first guide plate 710 with a tip portion 711 closer to the nip portion N than a tip portion 721 of the second guide plate 720 guides the sheet S toward the nip portion N. In the present embodiment, the first guide plate 710 is exemplified as the main guide.

The first guide plate 710 is formed of, for example, a conductive metal plate. The second guide plate 720 may be formed of, for example, resin integrated with the housing 200.

The guide structure 700 includes an auxiliary structure 730 attached to the tip portion 711 of the first guide plate 710. The auxiliary structure 730 helps the first guide plate 710 to guide a sheet S.

Figure 3:
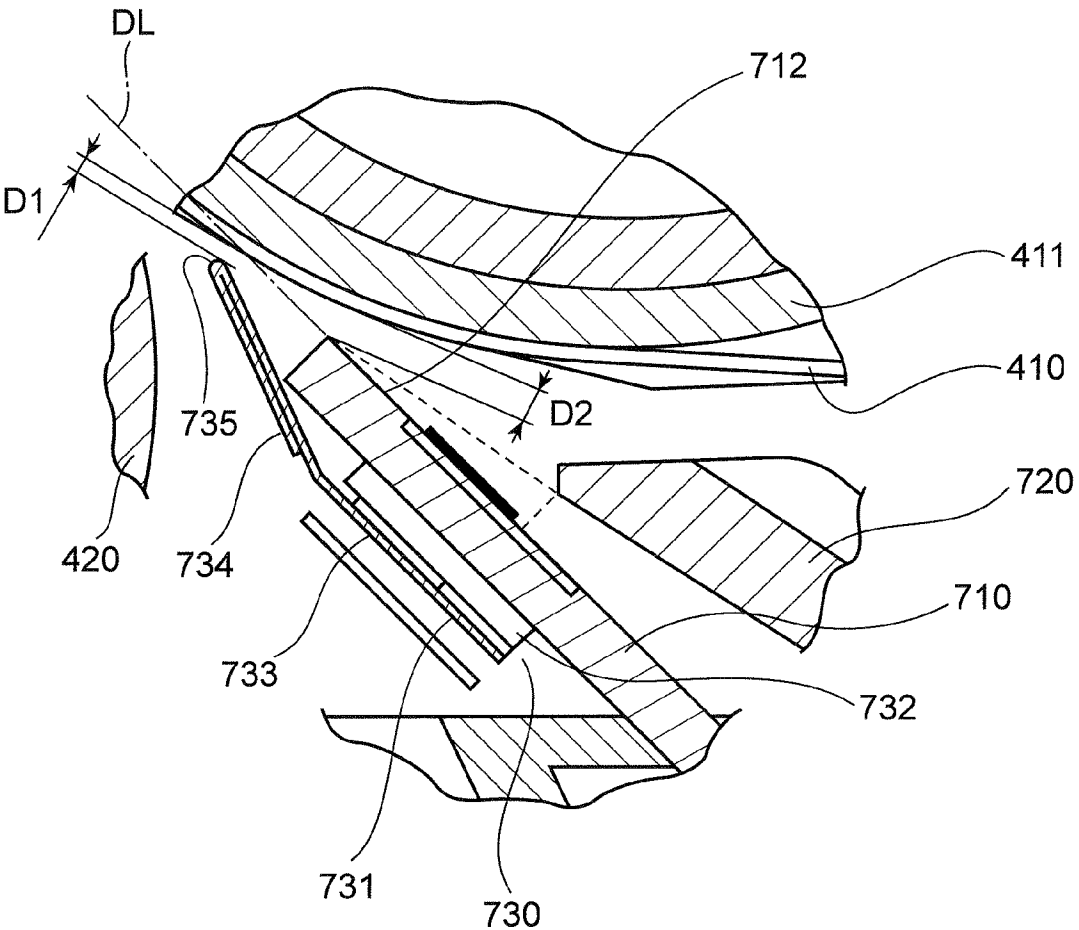
FIG. 3 is a schematic view of an auxiliary structure of the guide structure depicted in FIG. 2.

FIG. 3 is a cross-sectional view schematically showing the auxiliary structure 730. The auxiliary structure 730 is described with reference to FIGS. 2 and 3.

The auxiliary structure 730 includes an auxiliary plate 731, and a spacer 732 situated between the auxiliary plate 731 and the first guide plate 710. The auxiliary plate 731 is formed by, for example, bending a conductive metal plate. The spacer 732 may be formed from a conductive metal block. In the present embodiment, the auxiliary structure 730 is exemplified as the sub-guide.

The auxiliary plate 731 includes a proximal end piece 733 attached to the first guide plate 710 via the spacer 732, and a tip piece 734 which is bent from the proximal end piece 733 and protruded toward the nip portion N. The tip piece 734 has a double-plate structure, which is obtained by the bending process. As a result, a tip edge 735 of the tip piece 734 which comes in contact with a sheet S moving toward the nip portion N has an arc-like contour. Therefore it is less likely that the sheet S is damaged. In the present embodiment, the auxiliary plate 731 is exemplified as the conductive portion.

As described above, the conductive auxiliary plate 731 conducts electricity to the conductive first guide plate 710 via the conductive spacer 732. Therefore it becomes likely that electrostatic charge of the auxiliary plate 731 resulting from friction between the sheet S and the tip edge 735 suitably disappears.

Figure 4:
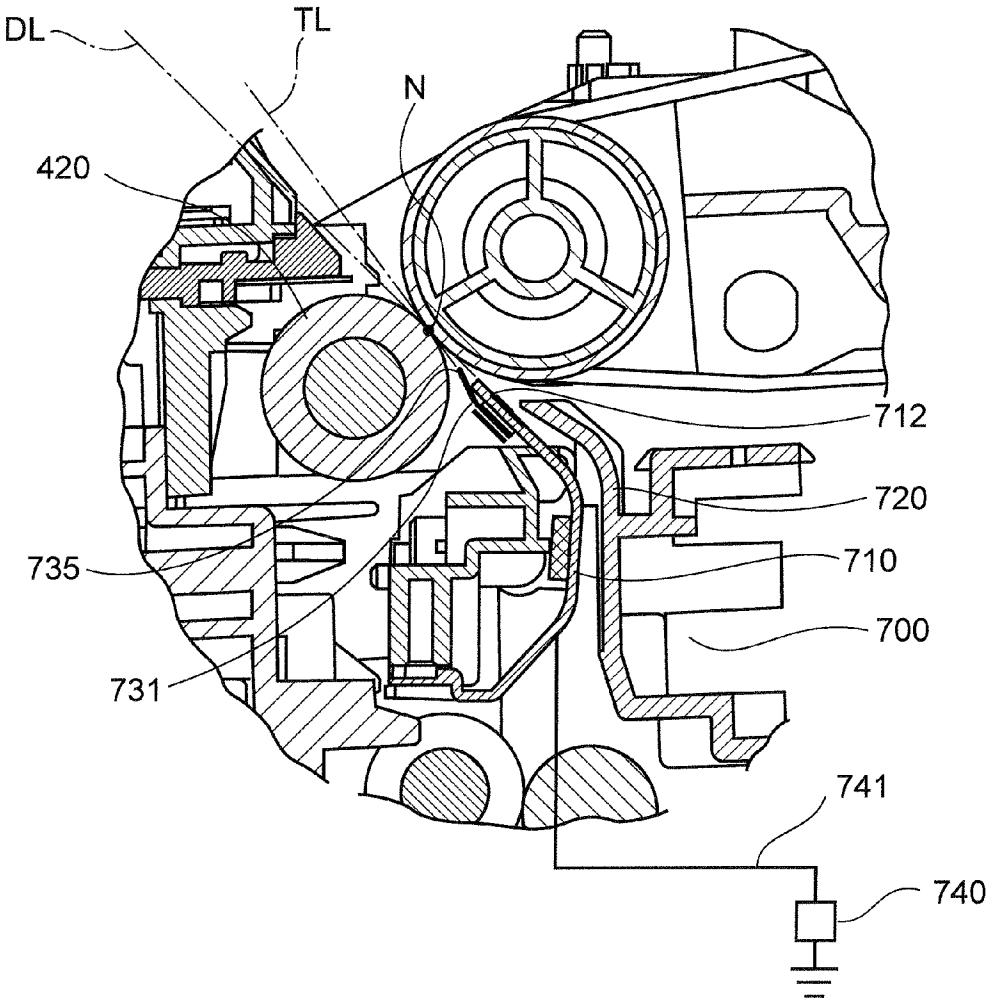
FIG. 4 is an enlarged view of a structure around a nip portion formed between a transfer roller and a transfer belt of the image formation apparatus depicted in FIG. 1.

FIG. 4 is an enlarged view of a structure around the nip portion N. The guide structure 700 is further described with reference to FIGS. 3 and 4.

The guide structure 700 includes a resistance element 740 such as a varistor or a high resistance metal glaze resistor. The resistance element 740 is situated at a midpoint in a grounding electric wire 741, which extends from the first guide plate 710. The resistance value of the resistance element 740 is set to a level sufficient enough to suppress a current flowing from the transfer roller 420, which electrostatically performs toner image transfer, toward the first guide plate 710. Accordingly, even if the auxiliary plate 731 is situated nearby the transfer roller 420, it is less likely that current unnecessarily flows to the guide structure 700.

The first guide plate 710 includes a delivery surface 712 which defines a delivery direction of the sheet S moving toward the nip portion N. The auxiliary structure 730 is attached to a surface of the first guide plate 710 opposite to the delivery surface 712. FIGS. 3 and 4 show delivery lines DL, respectively, which extend downstream along the delivery surface 712. The delivery line DL defined by the delivery surface 712 extends toward the nip portion N.

As described above, the auxiliary plate 731 of the auxiliary structure 730 includes the tip edge 735 facing the nip portion N. The tip edge 735 is positioned on a side of the transfer roller 420 with respect to the delivery line DL. As shown in FIG. 3, it is preferable to determine a protrusion amount of the auxiliary plate 731 from the first guide plate 710 such that a distance D1 between the tip edge 735 and the outer peripheral surface of the transfer belt 410 becomes shorter than a distance D2 between the first guide plate 710 and the outer peripheral surface of the transfer belt 410. Thus, the tip edge 735 is disposed at a position sufficiently close to the transfer belt 410. It should be noted that the distance D2 is preferably set to a range of 0.2 mm or more and 1.0 mm or less.

Figure 5:
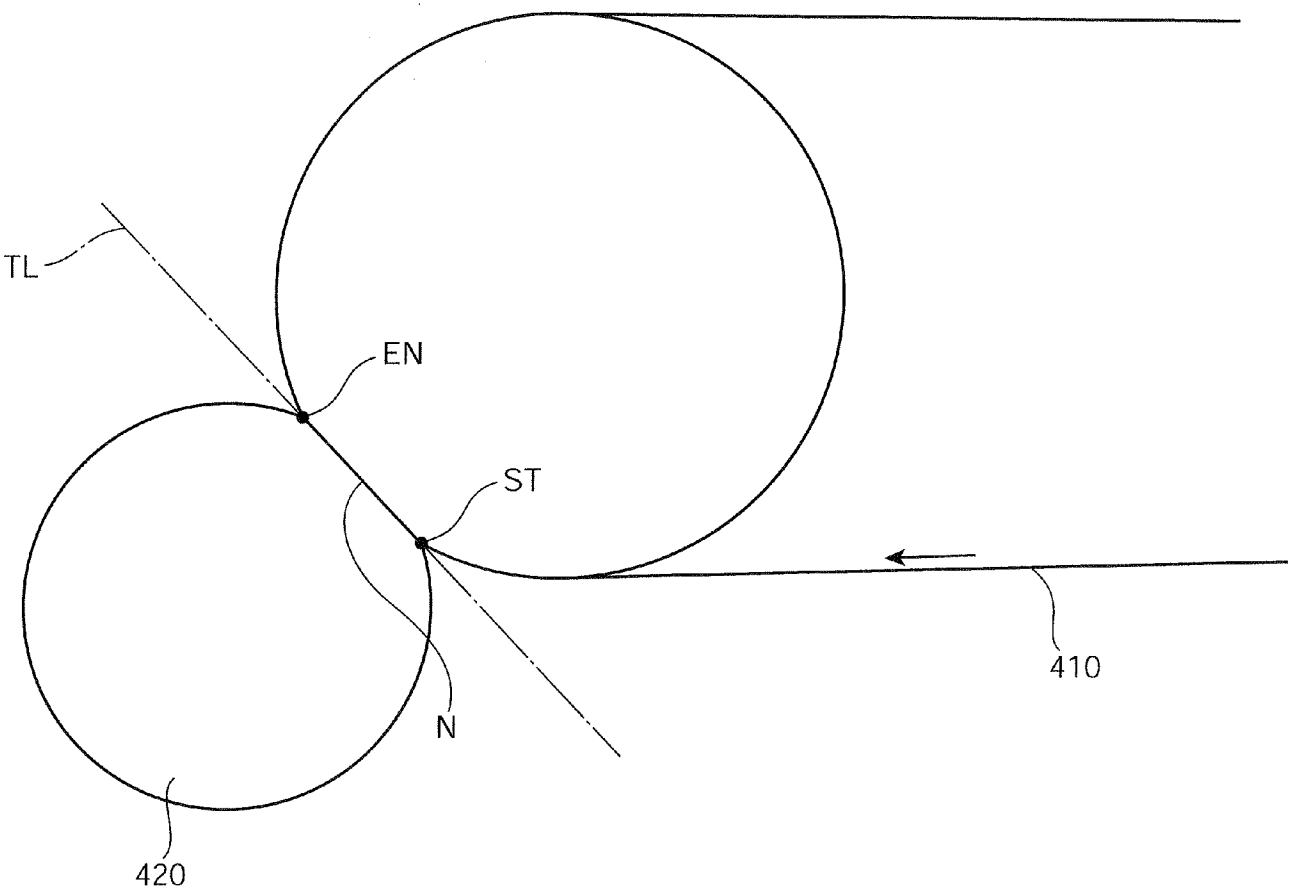
FIG. 5 is a schematic view of the nip portion depicted in FIG. 4.

FIG. 5 is a schematic view schematically showing the nip portion N. The guide structure 700 is further described with reference to FIGS. 4 and 5.

As shown in FIG. 5, the nip portion N is defined between a contact start point ST where contact between the outer peripheral surface of the transfer belt 410 and the outer peripheral surface of the transfer roller 420 starts and a contact end point EN where the contact between the outer peripheral surface of the transfer belt 410 and the outer peripheral surface of the transfer roller 420 ends. Each of FIGS. 4 and 5 shows a nip tangent line TL joining the contact start point ST to the contact end point EN.

As shown in FIG. 4, the nip tangent line TL intersects the delivery line DL at the nip portion N. In the upstream side of the nip portion N, the delivery line DL extending from the delivery surface 712 is closer to the transfer belt 410 than the nip tangent line TL. The delivery surface 712 is closer to the transfer belt 410 than the nip tangent line TL, so that the delivery line DL is appropriately directed toward the nip portion N. In addition, it becomes less likely that there is an unnecessary interference between the auxiliary plate 731 and the sheet S moving to the nip portion N.

<Second Embodiment>

Figure 6:
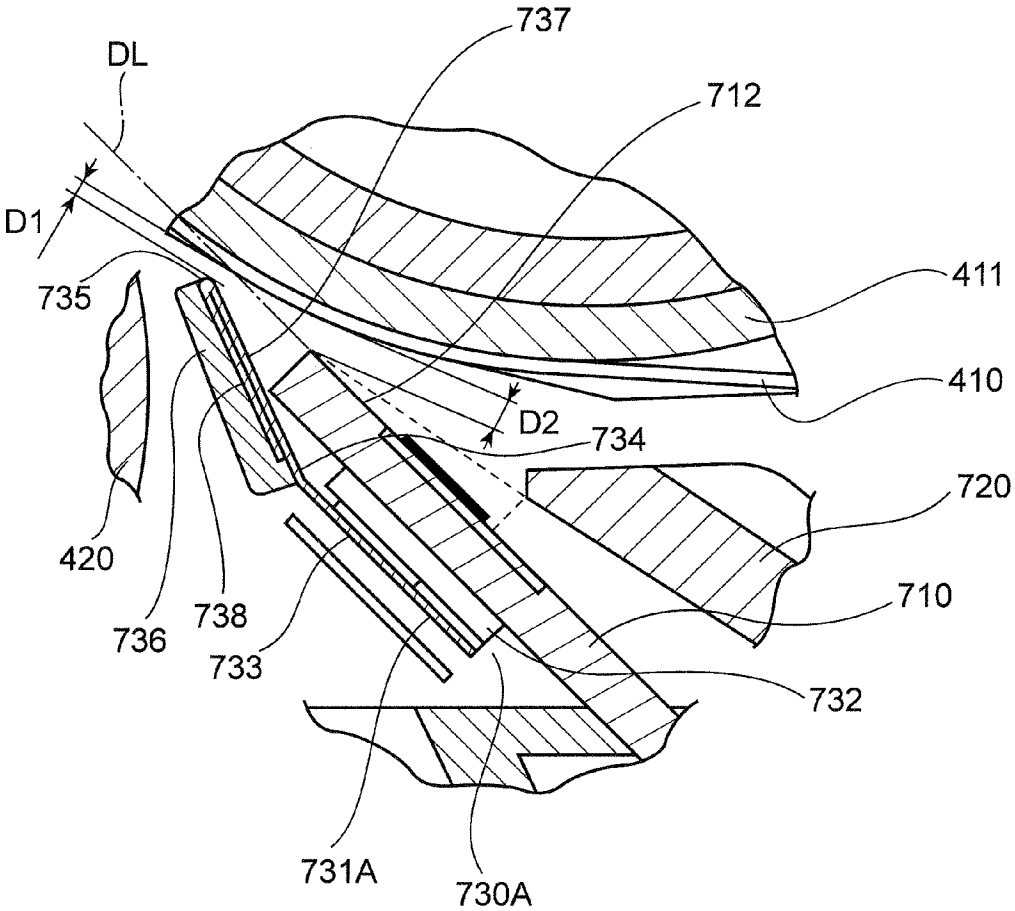
FIG. 6 is a schematic view of an auxiliary mechanism of an image formation apparatus according to the second embodiment.

FIG. 6 is a cross-sectional view schematically showing an auxiliary structure used in an image formation apparatus according to the second embodiment. Differences between the image formation apparatuses according to the first and second embodiments are described with reference to FIG. 6. It should be noted that descriptions of the image formation apparatus according to the first embodiment is applicable to features excluded from the following description. Among elements shown in FIG. 6, the same elements as those described in the context of the first embodiment are designated by the same reference numerals.

An auxiliary plate 731A of an auxiliary structure 730A includes a coating layer 736. The tip piece 734 of the auxiliary plate 731A includes a first surface 737 facing the transfer belt 410, and a second surface 738 facing the transfer roller 420. The coating layer 736 covers the second surface 738. The coating layer 736 has a resistance value in a range of $10^3\Omega$ or more and $10^{12}\Omega$ or less. Thus, it is less likely that current flows from the transfer roller 420 toward the auxiliary plate 731A and the first guide plate 710.

As described above, the coating layer 736 brings substantially the same current suppression effect as that of the resistance element 740 used in the image formation apparatus according to the first embodiment. Therefore it is not necessary that the image formation apparatus according to the second embodiment has the resistance element 740.

<Third Embodiment>

Figure 7:
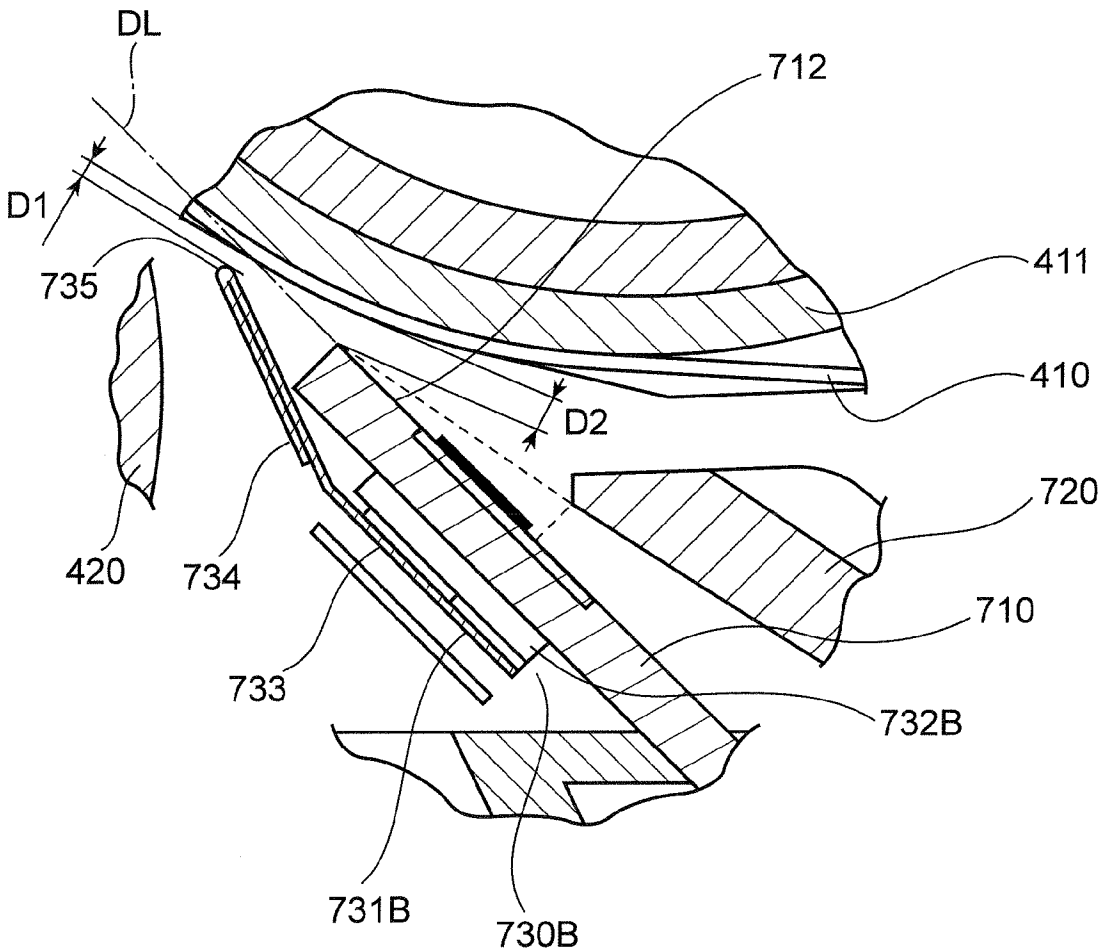
FIG. 7 is a schematic view of an auxiliary mechanism of an image formation apparatus according to the third embodiment.

FIG. 7 is a cross-sectional view schematically showing an auxiliary structure of an image formation apparatus according to the third embodiment. Differences between the image formation apparatuses according to the first and third embodiments are described with reference to FIG. 7. It should be noted that descriptions of the image formation apparatus according to the first embodiment is applicable to features excluded from the following description. Among elements shown in FIG. 7, the same elements as those described in the context of the first embodiment are designated by the same reference numerals.

An auxiliary structure 730B has a nonconductive spacer 732B. The spacer 732B is situated between a conductive auxiliary plate 731B and the conductive first guide plate 710.

Figure 8:
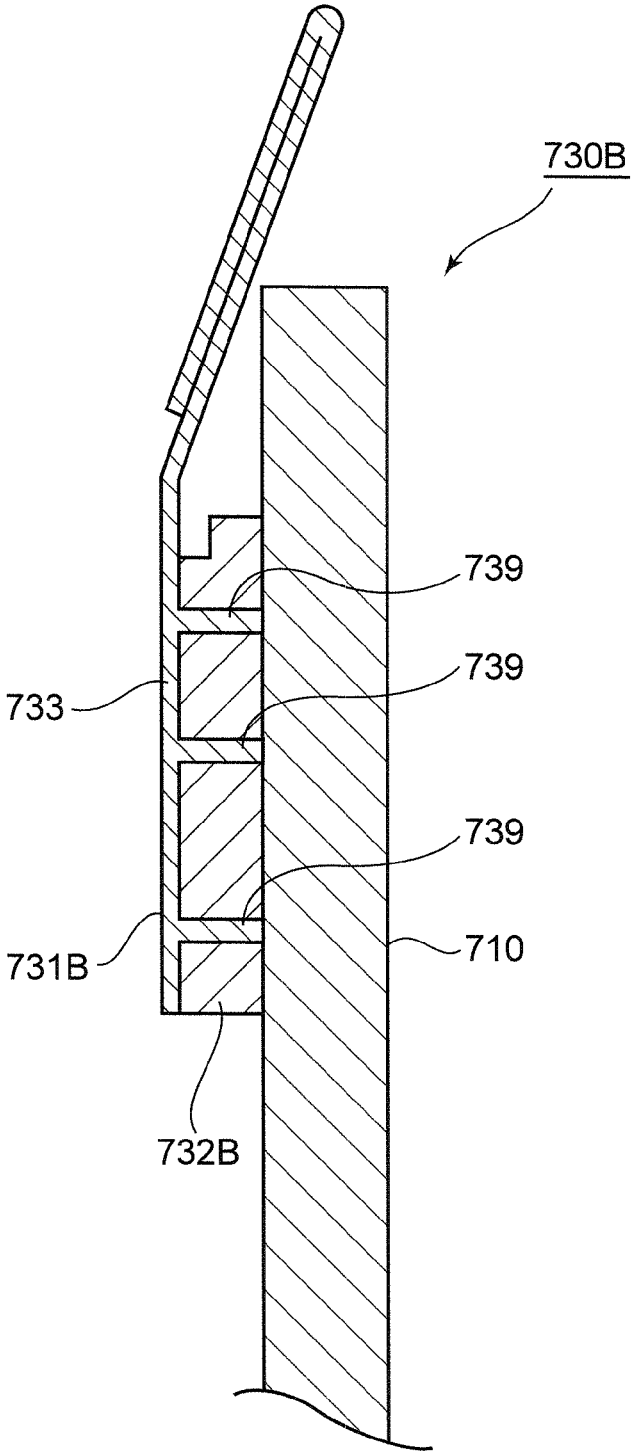
FIG. 8 is a schematic cross-sectional view of the auxiliary mechanism depicted in FIG. 7.

FIG. 8 is a schematic enlarged cross-sectional view around the spacer 732B. The auxiliary structure 730B is further described with reference to FIGS. 7 and 8.

The proximal end piece 733 of the auxiliary plate 731B includes a conductive path 739, which intersects the spacer 732B and protrudes toward the first guide plate 710. The auxiliary plate 731B is electrically connected with the first guide plate 710 via the conductive path 739. Accordingly, it is less likely that there is electrostatic charge of the auxiliary plate 731B resulting from the friction between the auxiliary plate 731B and the sheet S.

By the electrical connection between the auxiliary plate 731B and the first guide plate 710 by means of the conductive path 739 having a small cross section and the nonconductive spacer 732B, it becomes less likely that current flows from the transfer roller 420 toward the auxiliary plate 731B and the first guide plate 710.

This application is based on Japanese Patent application No. 2010-170337 filed in Japan Patent Office on Jul. 29, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image formation apparatus for forming a toner image on a sheet, comprising:

an image carrier configured to carry the toner image;

a transfer element configured to electrostatically transfer the toner image on the image carrier to the sheet; and a guide element configured to guide the sheet, wherein the image carrier and the transfer element form a nip portion for nipping the sheet, and the guide element includes a conductive main guide configured to guide the sheet toward the nip portion and a conductive sub-guide including a conductive portion protruding from the main guide toward the nip portion and a nonconductive spacer disposed between the conductive portion and the conductive main guide, the sub-guide conducts electricity to the conductive main guide, and the conductive portion includes a conductive path intersecting the spacer to be connected electrically with the conductive main guide.

2. The image formation apparatus according to claim 1, wherein the guide element includes a resistance element configured to suppress current flowing from the transfer element to the sub-guide, and the main guide is grounded via the resistance element.

3. The image formation apparatus according to claim 1, wherein the sub-guide includes a first surface facing the image carrier, a second surface facing the transfer element, and a coating layer covering the second surface, and a resistance value of the coating layer is $10^3\Omega$ or more and $10^{12}\Omega$ or less.

4. The image formation apparatus according to claim 1, wherein the conductive main guide includes a delivery surface defining a delivery direction of the sheet moving toward the nip portion, the sub-guide includes a tip edge facing the nip portion, the tip edge is positioned on a side of the transfer element with respect to a delivery line along the delivery direction of the sheet defined by the delivery surface, and a distance between the tip edge and the image carrier is not more than a distance between the conductive main guide and the image carrier.

5. The image formation apparatus according to claim 4, wherein the image carrier includes a first peripheral surface configured to carry the toner image, the transfer element includes a second peripheral surface pressed to the first peripheral surface to form the nip portion, and portions of the delivery line extending from the delivery surface and disposed on an upstream side of the nip portion are closer to the image carrier than a nip tangent line joining a contact start point where the first and second peripheral surfaces start to contact with each other and a contact end point where the contact between the first and second peripheral surfaces ends.

6. The image formation apparatus according to claim 5, wherein a distance between the delivery surface and the first peripheral surface is 0.2 mm or more and 1.0 mm or less.

* * * * *